US012504177B2

(12) United States Patent
Miranda-Pierce et al.

(10) Patent No.: US 12,504,177 B2
(45) Date of Patent: Dec. 23, 2025

(54) DRAWER GUIDE FOR OVEN BOTTOM DRAWER

(71) Applicant: Haier US Appliance Solutions, Inc., Wilmington, DE (US)

(72) Inventors: Mariana Miranda-Pierce, Louisville, KY (US); Nathan Nelson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 257 days.

(21) Appl. No.: 18/331,325

(22) Filed: Jun. 8, 2023

(65) Prior Publication Data

US 2024/0410590 A1 Dec. 12, 2024

(51) Int. Cl.
*F24C 15/16* (2006.01)
*A47B 88/40* (2017.01)

(52) U.S. Cl.
CPC ..... *F24C 15/168* (2013.01); *A47B 88/40* (2017.01)

(58) Field of Classification Search
CPC ..... A47B 88/042; A47B 88/40; A47B 88/402; A47B 88/407; A47B 88/413; A47B 88/427; A47B 88/437; A47B 2210/0002; A47B 2210/0029; A47B 2210/0056; A47B 2210/0059; A47B 2210/17; F24C 15/16; F24C 15/168; F25D 25/024; F25D 23/067; F25D 25/025
USPC ..... 312/330.1, 334.6, 334.8, 334.14, 334.16, 312/334.27, 334.35, 334.36, 349, 408, 312/410; 384/7, 13, 16, 20, 96, 110
See application file for complete search history.

(56) References Cited

U.S. PATENT DOCUMENTS

| | | | | |
|---|---|---|---|---|
| 1,046,841 A * | 12/1912 | O'Brien | A47B 88/427 384/19 |
| 2,550,980 A * | 5/1951 | Drake | F25D 25/024 211/134 |
| 3,099,501 A * | 7/1963 | Hillson | A47B 88/487 312/334.21 |
| 6,846,053 B2 | 1/2005 | Salice | |
| 2004/0021406 A1 | 2/2004 | Salice | |

FOREIGN PATENT DOCUMENTS

| | | |
|---|---|---|
| CN | 104859551 B | 4/2018 |
| DE | 102012218006 A1 | 4/2014 |
| JP | 2012245174 A | 12/2012 |
| WO | WO2010046456 A1 | 4/2010 |

* cited by examiner

*Primary Examiner* — Daniel J Troy
*Assistant Examiner* — Elizabeth Irene Artalejo
(74) *Attorney, Agent, or Firm* — Dority & Manning, P.A.

(57) ABSTRACT

A drawer guide includes a main body defining a lateral slide support surface extending along the vertical direction; a first protrusion protruding from the lateral slide support surface along the lateral direction to define a lateral lubricant pocket; a slide extension extending from the main body along the lateral direction, the slide extension defining a vertical slide support surface; and a second protrusion protruding from the vertical slide support surface along the vertical direction to define a vertical lubricant pocket, wherein the slide extension is provided below the first protrusion along the vertical direction such that the lateral slide support surface and the vertical slide support surface form an L shape.

13 Claims, 7 Drawing Sheets

DRAWER GUIDE FOR OVEN BOTTOM DRAWER

FIELD OF THE INVENTION

The present subject matter relates generally to drawer guides, and more particularly to drawer guides for under-oven mounted drawers.

BACKGROUND OF THE INVENTION

Conventional ovens are household appliances used to cook or reheat food items or cooking utensils, such as baking dishes or pans. Users may store certain cooking utensils in convenient places for ease of access. For instance, some conventional ovens include a drawer underneath an oven cavity, such as to store pots, pans, or other utensils. The drawer may be configured to slide into and away from a space below the oven cavity, for instance, along one or more rails. Accordingly, certain features, such as drawer slides or guides, that aid in the sliding ability of the drawer are required.

Existing guides for aiding in sliding of drawers exhibit certain drawbacks. For instance, conventional guides include multiple contact points between the guide itself and the drawer body. Such contact points result in additional wear and tear on the drawer body and the drawer guide. As a result, a lubricant may be applied to the guide to assist in a smooth motion and reduced noise and wear. Generally, the lubricant is applied to a single or multiple distinct locations, however, and may be dispersed to areas where it is ineffective. As a result, the contact points between the drawer body and the drawer guide are left unlubricated, resulting in unwanted noise and increased pulling force required to withdraw the drawer body from a receiving space.

Accordingly, a drawer guide with features that obviate one or more of the aforementioned drawbacks would be useful. In particular, a drawer guide with improved lubricant retention would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a drawer guide is provided. The drawer guide may include a main body defining a lateral slide support surface extending along the vertical direction; a first protrusion protruding from the lateral slide support surface along the lateral direction to define a lateral lubricant pocket; a slide extension extending from the main body along the lateral direction, the slide extension defining a vertical slide support surface; and a second protrusion protruding from the vertical slide support surface along the vertical direction to define a vertical lubricant pocket, wherein the slide extension is provided below the first protrusion along the vertical direction such that the lateral slide support surface and the vertical slide support surface form an L shape.

In another exemplary aspect of the present disclosure, a drawer assembly for an appliance is provided. The appliance may include a frame defining an opening. The drawer assembly may include a drawer body selectively received within the opening between an inserted position and a withdrawn position; and a drawer guide attached to the frame, the drawer guide being in sliding contact with the drawer body. The drawer guide may include a main body defining a lateral slide support surface extending along the vertical direction; a first protrusion protruding from the lateral slide support surface along the lateral direction to define a lateral lubricant pocket; a slide extension extending from the main body along the lateral direction, the slide extension defining a vertical slide support surface; and a second protrusion protruding from the vertical slide support surface along the vertical direction to define a vertical lubricant pocket, wherein the slide extension is provided below the first protrusion along the vertical direction such that the lateral slide support surface and the vertical slide support surface form an L shape.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
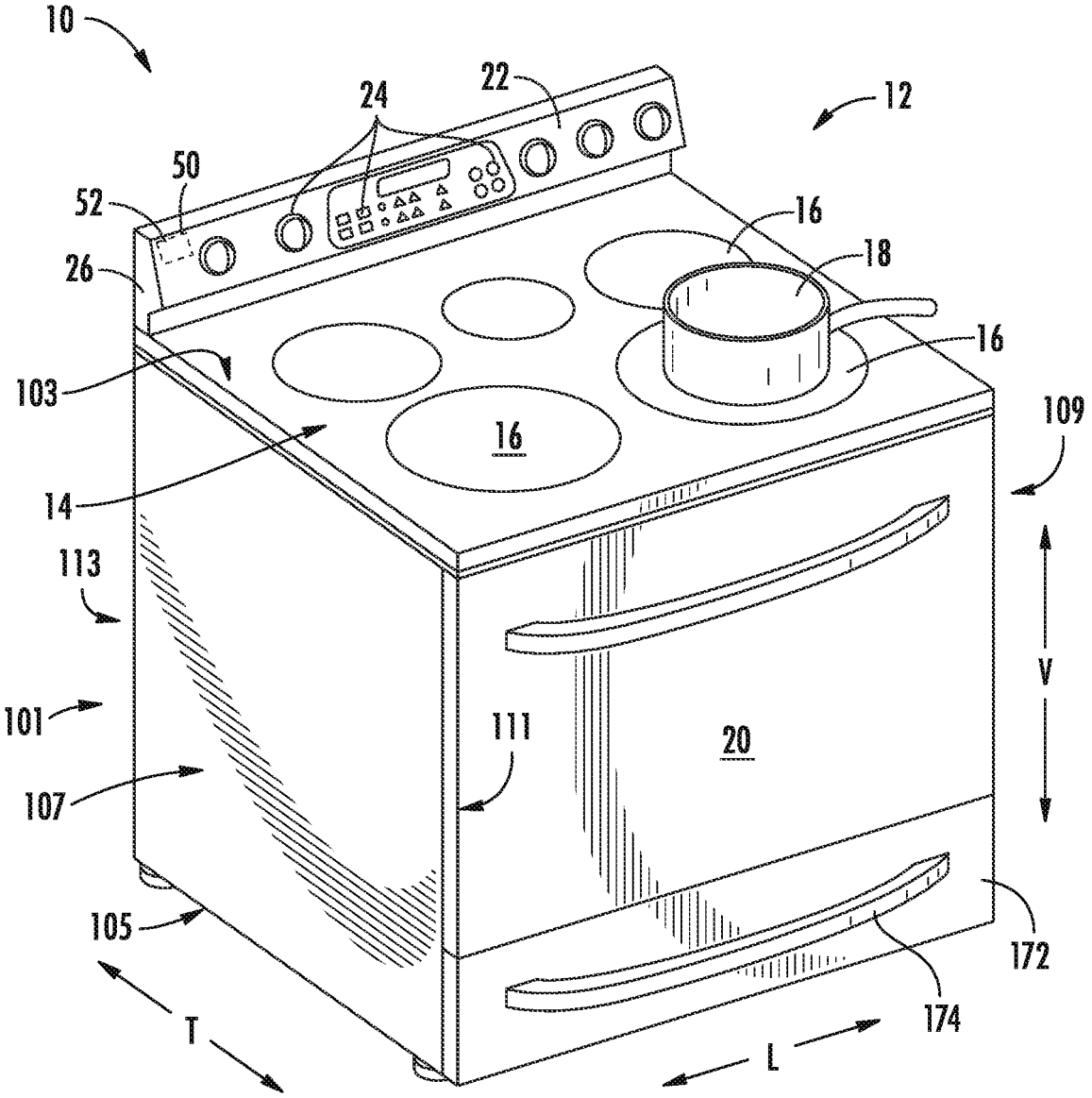
FIG. 1 provides a perspective view of an oven range according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
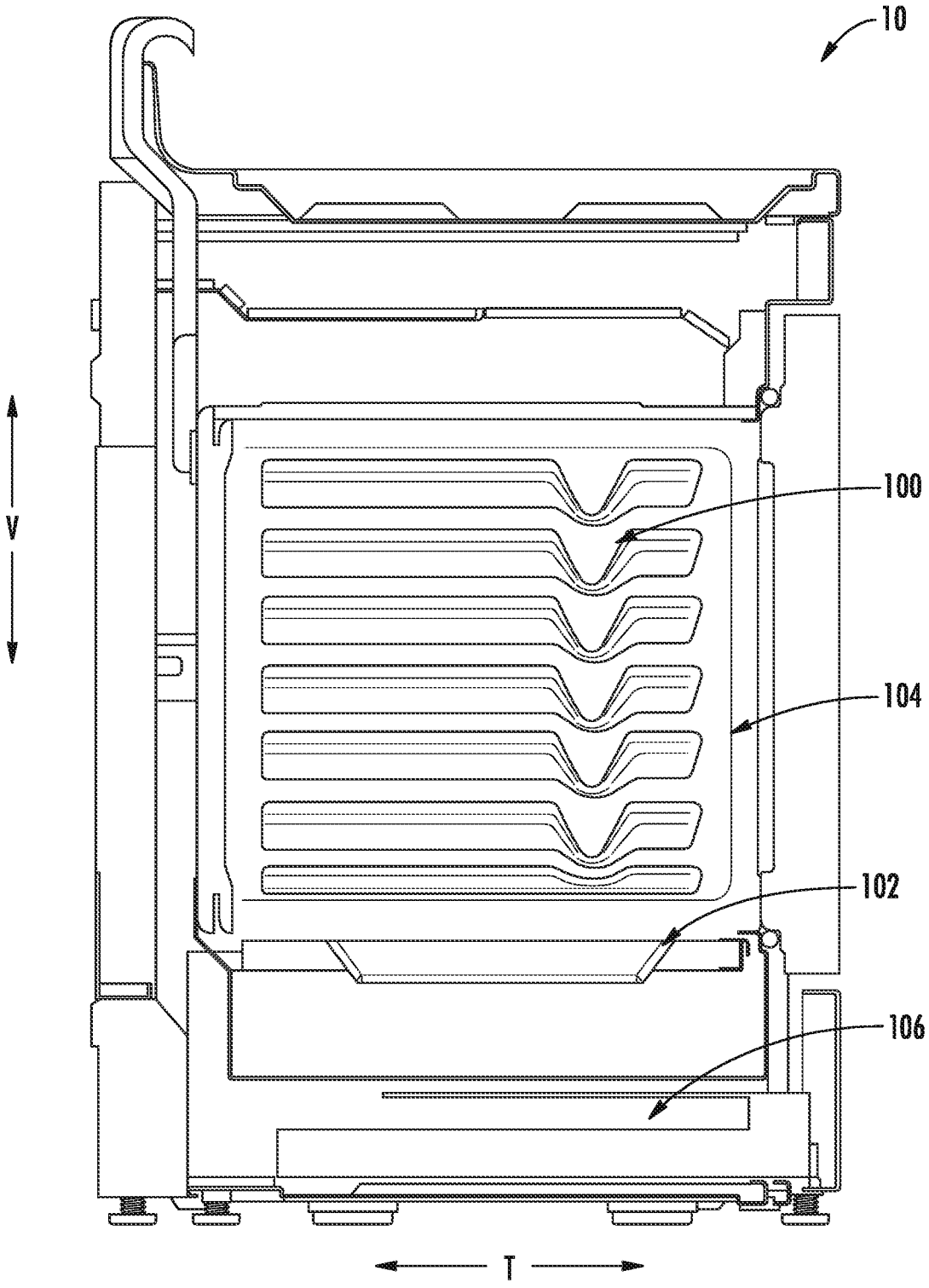
FIG. 2 provides a side cut-away view of the exemplary oven range of FIG. 1.

FIG. 1 provides a perspective view of a range appliance, or oven range 10, including a cooktop 12, and FIG. 2 provides a side cut-away view of the range appliance. Oven range 10 is provided by way of example only and is not intended to limit the present subject matter to the arrangement shown in FIGS. 1 and 2. Thus, the present subject matter may be used with other range 10 and/or cooktop 12 configurations, e.g., double oven range appliances. As illustrated, oven range 10 generally defines a vertical direction V, a lateral direction L, and a transverse direction T, each of which is mutually perpendicular, such that an orthogonal coordinate system is generally defined. Oven range 10 includes a cabinet 101 that extends between a top 103 and a bottom 105 along the vertical direction V, between a left side 107 and a right side 109 along the lateral direction, and between a front 111 and a rear 113 along the transverse direction T.

A cooking surface 14 of cooktop 12 includes a plurality of heating elements 16. For the embodiment depicted, the cooktop 12 includes five heating elements 16 spaced along cooking surface 14. The heating elements 16 are generally electric heating elements and are positioned at, e.g., on or proximate to, the cooking surface 14. In certain exemplary embodiments, cooktop 12 may be a radiant cooktop with resistive heating elements or coils mounted below cooking surface 14. However, in other embodiments, the cooktop appliance 12 may include any other suitable shape, configuration, and/or number of heating elements 16, for example, the cooktop 12 may be an open coil cooktop with the heating elements 16 positioned on or above surface 14. Additionally, in other embodiments, the cooktop 12 may include any other suitable type of heating element 16, such as an induction heating element. Each of the heating elements 16 may be the same type of heating element 16, or cooktop 12 may include a combination of different types of heating elements 16.

As shown in FIG. 1, a cooking utensil 18, such as a pot, pan, or the like, may be placed on a heating element 16 to heat the cooking utensil 18 and cook or heat food items placed in cooking utensil 18. Range appliance 10 also includes a door 20 that permits access to a cooking chamber 104 of oven range 10, e.g., for cooking or baking of food items therein. A control panel 22 having controls 24 permits a user to make selections for cooking of food items. Although shown on a backsplash or back panel 26 of oven range 10, control panel 22 may be positioned in any suitable location. Controls 24 may include buttons, knobs, and the like, as well as combinations thereof, and/or controls 24 may be implemented on a remote user interface device such as a smartphone, as described below. As an example, a user may manipulate one or more controls 24 to select a temperature and/or a heat or power output for each heating element 16 and the cooking chamber 104. The selected temperature or heat output of heating element 16 affects the heat transferred to cooking utensil 18 placed on heating element 16.

The cooktop appliance 12 includes a control system 50 for controlling one or more of the plurality of heating elements 16 and the cooking chamber 104. Specifically, the control system 50 may include a controller 52 operably connected to the control panel 22 and controls 24. The controller 52 may be operably connected to each of the plurality of heating elements 16 for controlling a power supply to each of the plurality of heating elements 16 in response to one or more user inputs received through the control panel 22 and controls 24.

The cooktop appliance 12 may include a drawer recess 106, into which a drawer assembly 108 (described in more detail below) may be inserted. Drawer recess 106 may be provided underneath cooking chamber 104, for example. A user may store various items (e.g., cooking utensils 18 or the like) within drawer recess 106. Additionally or alternatively, drawer recess 106 may be used as a temporary storage area for food (e.g., as a warming zone or area). According to some embodiments, drawer recess 106 may be an additional cooking or baking zone, in which food items may be cooked or baked. It should be noted that drawer recess 106 may be used for any suitable purposes, and the disclosure is not limited to those examples given herein. An opening to drawer recess 106 may be defined in the lateral direction L and vertical direction V. In detail, drawer recess 106 may be configured such that drawer assembly 108 is withdrawn in the transverse direction T from drawer recess 106.

Figure 7:
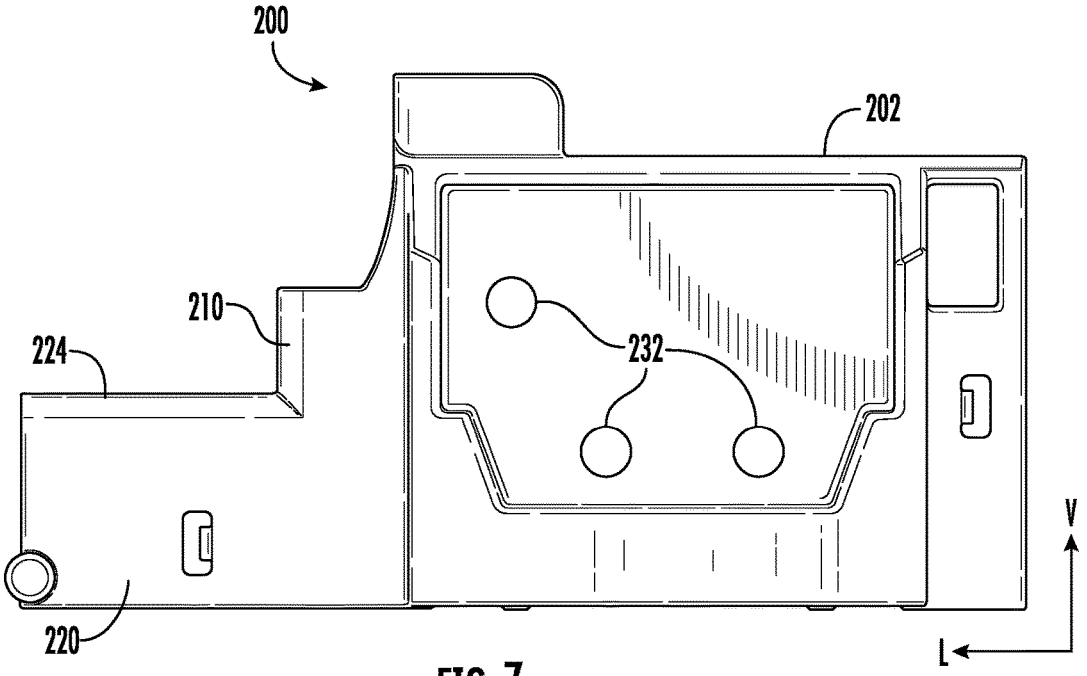
FIG. 7 provides a front view of the exemplary drawer guide of FIG. 6.

One or more drawer slide rails 118 may be located within drawer recess 106 (e.g., as seen in FIGS. 7 and 9). For example, drawer slide rail 118 may be attached to cabinet 101 (e.g., a frame of cabinet 101). In some embodiments, drawer slide rail 118 is formed as a part of cabinet 101. Drawer slide rail 118 may be arranged in the transverse direction T. In other words, drawer slide rail 118 may be orientated such that drawer assembly 108 slides along drawer slide rail 118 along the transverse direction T. The one or more drawer slide rails 118 may include a first drawer slide rail 118 provided at a first lateral side of drawer recess 106 and a second drawer slide rail 118 provided at a second lateral side of drawer recess 106. However, it should be appreciated that any suitable number of drawer slide rails 118 may be provided within drawer recess 106.

Drawer slide rail 118 may include a horizontal portion 1062 and a vertical portion 1064. Horizontal portion 1062 may protrude in the lateral direction L and extend in the transverse direction T. Vertical portion 1064 may protrude from a distal end of horizontal portion 1062 in the vertical direction V (e.g., downward), and extend in the transverse direction T. Accordingly, drawer slide rail may have an "L" shaped cross-section in a plane defined in the lateral direction L and the vertical direction V.

Drawer assembly 108 may include a main panel 110, a rear panel 112, a first side panel 114, and a second panel 116. Accordingly, main panel 110, rear panel 112, first side panel 114, and second side panel 116 may form a drawer body 109 having a cuboid shape into which various items may be placed. It should be noted that drawer body 109 may be formed from a single piece and bent into the cuboid shape according to certain embodiments. Drawer assembly 108 may include a front panel or door face 172 including a handle 174 (FIG. 1) used to withdraw and insert drawer assembly 108 into drawer recess 106. When assembled, first side panel 114 and second side panel 116 may be defined in the transverse direction T and the vertical direction V. Rear panel 112 may be defined in the lateral direction L and the vertical direction V. Main panel 110 may be defined in the lateral direction L and the transverse direction T. A rear portion of each of first side panel 114 and second side panel 116 may extend further in the transverse direction T than a position of rear panel 112. In other words, each of first side panel 114 and second side panel 116 may define an overhang or extension in the transverse direction (e.g., behind rear panel 112 in the transverse direction T, as seen in FIG. 7).

Figure 3:
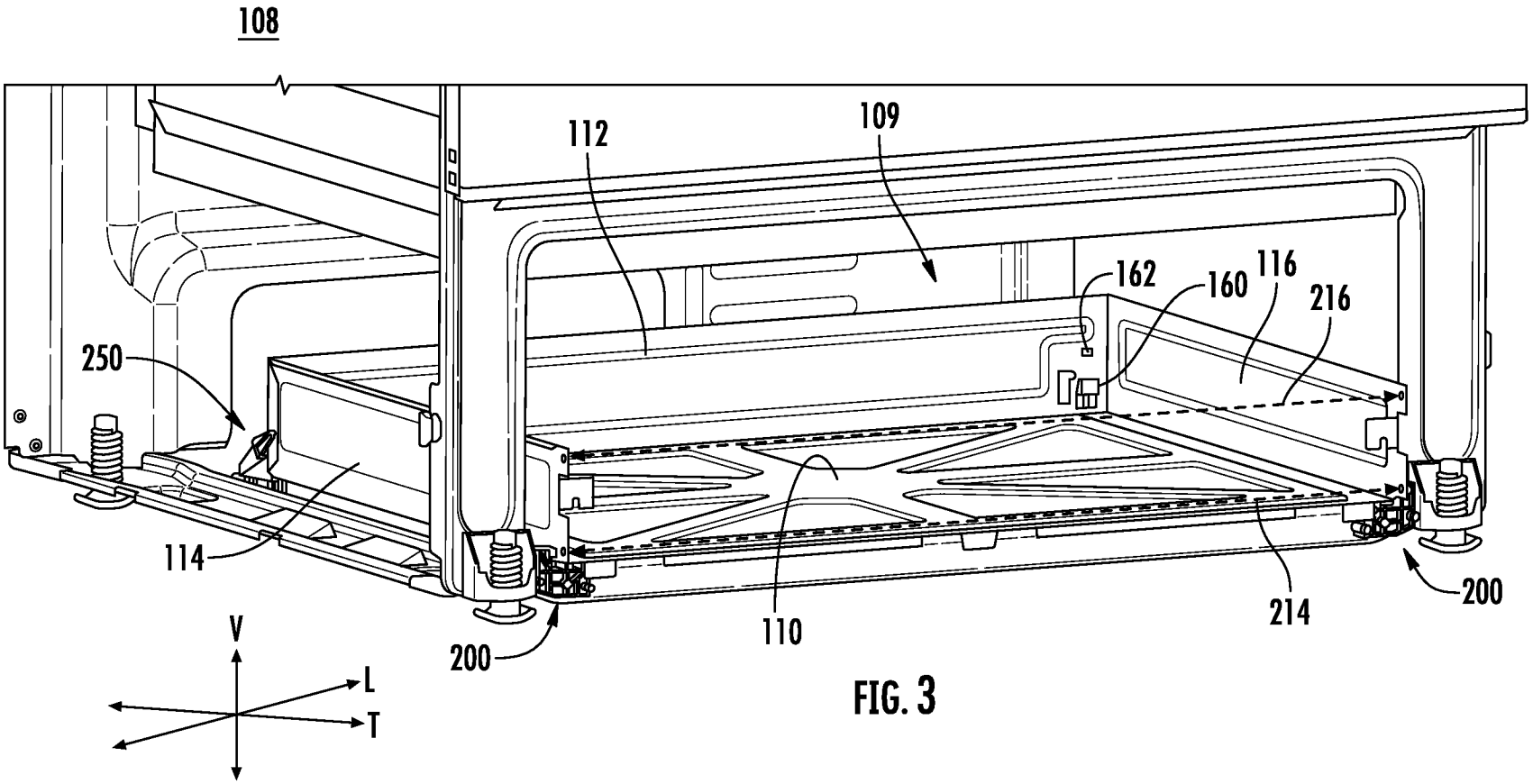
FIG. 3 provides a perspective cut-away view of a drawer assembly of the exemplary oven range of FIG. 1.

A latch hole 160 may be defined in rear panel 112 of drawer body 109. Latch hole 160 may be configured to accept and hold a first protrusion 284 (described below) of a rear drawer guide 250 (also described below). As best seen in FIG. 3, latch hole 160 may be located at or near a bottom of rear panel 112. Latch hole 160 may be predominantly square in shape. Additionally or alternatively, latch hole 160 may include one or more tabs that protrude from a top corner of latch hole 160 in the lateral direction L and vertical direction V. However, the geometry of latch hole 160 is not limited to that discussed herein, and any suitable shape may be used.

A catch hole 162 may be defined in rear panel 112 of drawer body 109. Catch hole 162 may be positioned above latch hole 160 (e.g., along the vertical direction V). Catch hole 162 may be configured to accept a second protrusion 156 (described below) of rear drawer guide 120. Catch hole 162 may be predominantly square in shape. However, the geometry of catch hole 162 is not limited to that discussed herein, and any suitable shape may be used.

Drawer assembly 108 may include a front drawer guide 200. In particular, as shown in FIG. 3, front drawer guide 200 may be attached to cabinet 101 (e.g., adjacent to drawer recess 106). Front drawer guide 200 may include first and second front drawer guides 200 (or left and right front drawer guides, according to some embodiments). In other words, a first front drawer guide 200 may be provided at or near a lower left corner of drawer recess 106, proximate front 111 and bottom 105 of cabinet 101. Similarly, a second front drawer guide 200 may be provided at or near a lower right corner of drawer recess 106, proximate front 111 and bottom 105 of cabinet 101. Drawer body 109 may be supported by front drawer guide 200. For instance, drawer body 109 may be withdrawn from drawer recess 106 while remaining in contact with front drawer guide 200.

Figure 4:
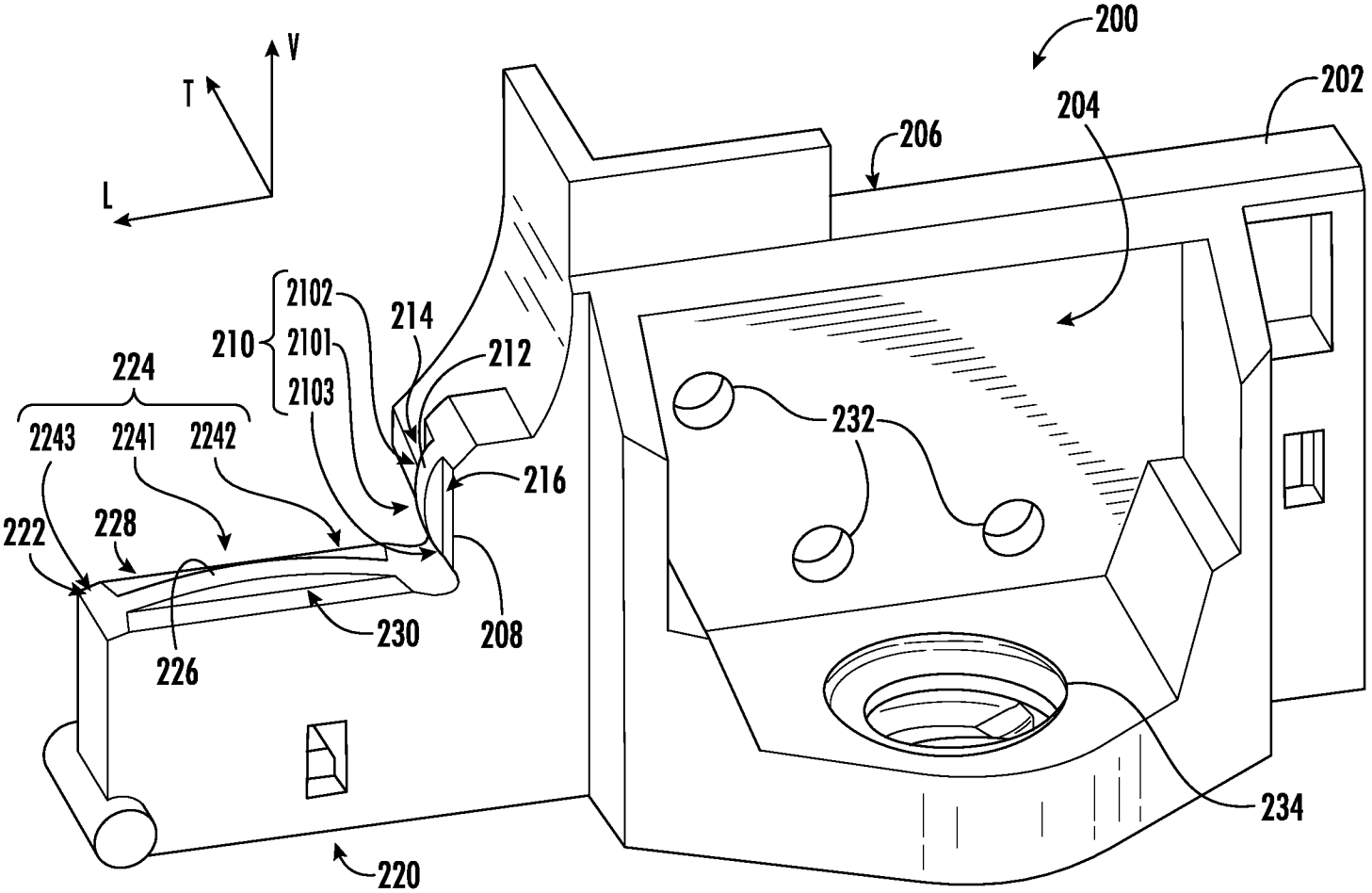
FIG. 4 provides a perspective view of a front drawer guide according to an exemplary embodiment of the present disclosure.

Referring now to FIG. 4, front drawer guide 200 may include a main body 202. Main body 202 may be generally rectangular in shape, extending along the vertical direction V and the lateral direction L. For instance, main body 202 may define a front face 204 and a rear face 206. Front face 204 may face a front of range appliance 10. Accordingly, rear face 206 may be provided opposite front face 204 and thus face a rear of range appliance 206. Main body 202 may further define a lateral slide support surface 208. Lateral slide support surface 208 may be provided on a lateral side of main body 202 (e.g., facing toward a lateral center of range appliance 10). As shown in FIG. 4, for instance, lateral slide support surface 208 may be provided on a left side of main body 202 (e.g., for a right front drawer guide).

Lateral slide support surface 208 may extend along the vertical direction V. For instance, lateral slide support surface 208 may form at least a portion of a side edge of main body 202. Additionally or alternatively, lateral slide support surface 208 may protrude from the side edge of main body 202 (e.g., toward a center of range appliance 10). Lateral slide support surface 208 may be a predominantly planar surface defined along the vertical direction V and the transverse direction T. Accordingly, lateral slide support surface 208 may face a side panel of drawer body 109 (e.g., second side panel 116).

Front drawer guide 200 may include a first protrusion 210. First protrusion 210 may protrude from lateral slide support surface 208. For instance, first protrusion 210 may protrude along the lateral direction L from lateral slide support surface 208 (e.g., toward drawer body 109). Accordingly, first protrusion 210 may selectively contact drawer body 109 (e.g., second side panel 116). According to at least some embodiments, first protrusion 210 extends along the vertical direction V. Additionally or alternatively, first protrusion 210 may be provided at a center (e.g., along the transverse direction T) of lateral slide support surface 208. Accordingly, first protrusion 210 may be defined as a portion of lateral slide support surface 208 protruding inward (e.g., toward the center of range appliance 10).

First protrusion 210 may define a lateral protrusion distance. For instance, a contact surface 212 of first protrusion 210 may be located a lateral protrusion distance away from lateral slide support surface 208. According to at least some embodiments, the lateral protrusion distance varies (e.g., along the vertical direction V). In detail, the lateral protrusion distance may be greater in some locations than in other locations, as defined along the vertical direction. For example, a central portion 2101 of first protrusion 210 may have a greater lateral protrusion distance than each of a first end 2102 and a second end 2103 of first protrusion 210.

Thus, according to some embodiments, first protrusion 210 has a curved shape, convex laterally outward from lateral slide support surface 208.

First protrusion 210 may define a first lateral lubricant pocket 214. First lateral lubricant pocket 214 may be provided behind (e.g., along the transverse direction T) first protrusion 210. For instance, first lateral lubricant pocket 214 may be defined as a space between first protrusion 210 and lateral slide support surface 208. In detail, a side surface (e.g., a rear side surface) of first protrusion 210 may be non-parallel with lateral slide support surface 208. According to some embodiments, the angle between the side surface of first protrusion 210 and lateral slide support surface 208 is between about 80 degrees and about 110 degrees. Thus, a lubricant (e.g., oil, grease, silicon, etc.) may be applied to first lateral lubricant pocket 214. Additionally or alternatively, the lubricant may be applied to contact surface 212 of first protrusion 210, to lateral slide support surface 208, or the like. Advantageously, as drawer body 109 is moved between the inserted position and the withdrawn position, the lubricant held within first lateral lubricant pocket 214 may be selectively picked up (e.g., by an outer surface of side panel 116 of drawer body 109), allowing the lubricant to be continually applied thereto.

First protrusion 210 may define a second lateral lubricant pocket 216. Second lateral lubricant pocket 216 may be provided opposite first lateral lubricant pocket 214 (e.g., along the transverse direction T in front of first protrusion 210). For instance, second lateral lubricant pocket 216 may be defined as a space between first protrusion 210 and lateral slide support surface 208. In detail, a side surface (e.g., a front side surface) of first protrusion 210 may be non-parallel with lateral slide support surface 208. According to some embodiments, the angle between the side surface of first protrusion 210 and lateral slide support surface 208 is between about 80 degrees and about 110 degrees. Thus, a lubricant (e.g., oil, grease, silicon, etc.) may be applied to second lateral lubricant pocket 216 (e.g., similar to first lateral lubricant pocket 214).

Front drawer guide 200 may include a slide extension 220. Slide extension 220 may extend from main body 202 along the lateral direction L. For instance, slide extension 220 may extend from a lateral edge of main body 202 (e.g., along the lateral direction L). According to some embodiments, slide extension 220 extends from lateral slide support surface 208 (e.g., toward drawer body 109). Additionally or alternatively, slide extension 220 may be provided below first protrusion 210 (e.g., along the vertical direction V). Accordingly, slide extension 220 and lateral slide support surface 208 may form an "L" shape. For instance, drawer body 109 may be selectively positioned within the "L" shape.

Slide extension 220 may define a vertical slide support surface 222. Vertical slide support surface 222 may be provided on a top side of slide extension 220 (e.g., facing toward a top of range appliance 10). As shown in FIG. 4, for instance, vertical slide support surface 222 may be provided on a left side of main body 202 (e.g., for a right front drawer guide).

Vertical slide support surface 222 may extend along the lateral direction L. For instance, vertical slide support surface 222 may form at least a portion of a top edge of slide extension 220. Additionally or alternatively, vertical slide support surface 222 may protrude from the top edge of slide extension 220 (e.g., toward a top of range appliance 10). Vertical slide support surface 222 may be a predominantly planar surface defined along the lateral direction L and the transverse direction T. Accordingly, vertical slide support surface 222 may face a bottom panel of drawer body 109 (e.g., main panel 110).

Front drawer guide 200 may include a second protrusion 224. Second protrusion 224 may protrude from vertical slide support surface 222. For instance, second protrusion 224 may protrude along the vertical direction V from vertical slide support surface 222 (e.g., toward drawer body 109). Accordingly, second protrusion 224 may selectively contact drawer body 109 (e.g., main panel 110). According to at least some embodiments, second protrusion 224 extends along the lateral direction L. Additionally or alternatively, second protrusion 224 may be provided at a center (e.g., along the transverse direction T) of vertical slide support surface 222. Accordingly, second protrusion 224 may be defined as a portion of vertical slide support surface 222 protruding upward (e.g., toward the top of range appliance 10).

Second protrusion 224 may define a vertical protrusion distance. For instance, a contact surface 226 of second protrusion 224 may be located a vertical protrusion distance away from vertical slide support surface 222. According to at least some embodiments, the vertical protrusion distance varies (e.g., along the lateral direction L). In detail, the vertical protrusion distance may be greater in some locations than in other locations, as defined along the lateral direction. For example, a central portion 2241 of second protrusion 224 may have a greater lateral protrusion distance than each of a first end 2242 and a second end 2243 of second protrusion 224. Thus, according to some embodiments, second protrusion 224 has a curved shape, convex vertically upward from vertical slide support surface 222.

Second protrusion 224 may define a first vertical lubricant pocket 228. First vertical lubricant pocket 228 may be provided behind (e.g., along the transverse direction T) second protrusion 224. For instance, first vertical lubricant pocket 228 may be defined as a space between second protrusion 228 and vertical slide support surface 222. In detail, a side surface (e.g., a rear surface) of second protrusion 224 may be non-parallel with vertical slide support surface 222. According to some embodiments, the angle between the rear surface of second protrusion 224 and vertical slide support surface 222 is between about 80 degrees and about 110 degrees. Thus, a lubricant (e.g., oil, grease, silicon, etc.) may be applied to first vertical lubricant pocket 228. Additionally or alternatively, the lubricant may be applied to contact surface 226 of second protrusion 224, to vertical slide support surface 222, or the like. Advantageously, as drawer body 109 is moved between the inserted position and the withdrawn position, the lubricant held within first vertical lubricant pocket 228 may be selectively picked up (e.g., by a bottom surface of main panel 110 of drawer body 109), allowing the lubricant to be continually applied thereto.

Second protrusion 224 may define a second vertical lubricant pocket 230. Second vertical lubricant pocket 230 may be provided opposite first vertical lubricant pocket 228 (e.g., along the transverse direction T in front of second protrusion 224). For instance, second vertical lubricant pocket 230 may be defined as a space between second protrusion 224 and vertical slide support surface 222. In detail, a front surface of second protrusion 224 may be non-parallel with vertical slide support surface 222. According to some embodiments, the angle between the front surface of second protrusion 224 and vertical slide support surface 222 is between about 80 degrees and about 110 degrees. Thus, a lubricant (e.g., oil, grease, silicon, etc.) may be applied to second vertical lubricant pocket 230 (e.g., similar to first vertical lubricant pocket 230).

Front drawer guide 200 may include a plurality of fastener apertures 232. In detail, the plurality of fastener holes 232 may be defined through main body 202 along the transverse direction T. The plurality of fastener holes 232 may extend from front face 204 to rear face 206 (e.g., along the transverse direction T). Further, the plurality of fastener holes 232 may be spaced apart along each of the vertical direction V and the lateral direction L. As shown in the figures, three fastener holes 232 may be provided, however it should be understood that the number of fastener holes 232 shown is by way of example only, and that any suitable number of fastener holes 232 may be provided. Accordingly, front drawer guide 200 may be selectively fastened to range appliance 10 (e.g., to cabinet 101 adjacent to drawer recess 106) via one or more fasteners (such as screws, bolts, pins, rivets, or the like).

Front drawer guide 200 may include a leg aperture 234. Leg aperture 234 may be defined as a through hole through main body 202. For instance, leg aperture 234 may be defined axially along the vertical direction V. Leg aperture 234 may be formed through an extension extending from front face 204 of main body 202 along the transverse direction T (e.g., toward a front of range appliance 10). Leg aperture 234 may be a threaded hole. For instance, leg aperture 234 may include features for receiving a threaded fastener or appendage. According to at least some embodiments, a leg of range appliance 10 is received within leg aperture 234 via threaded engagement to adjust a height of range appliance.

Figure 5:
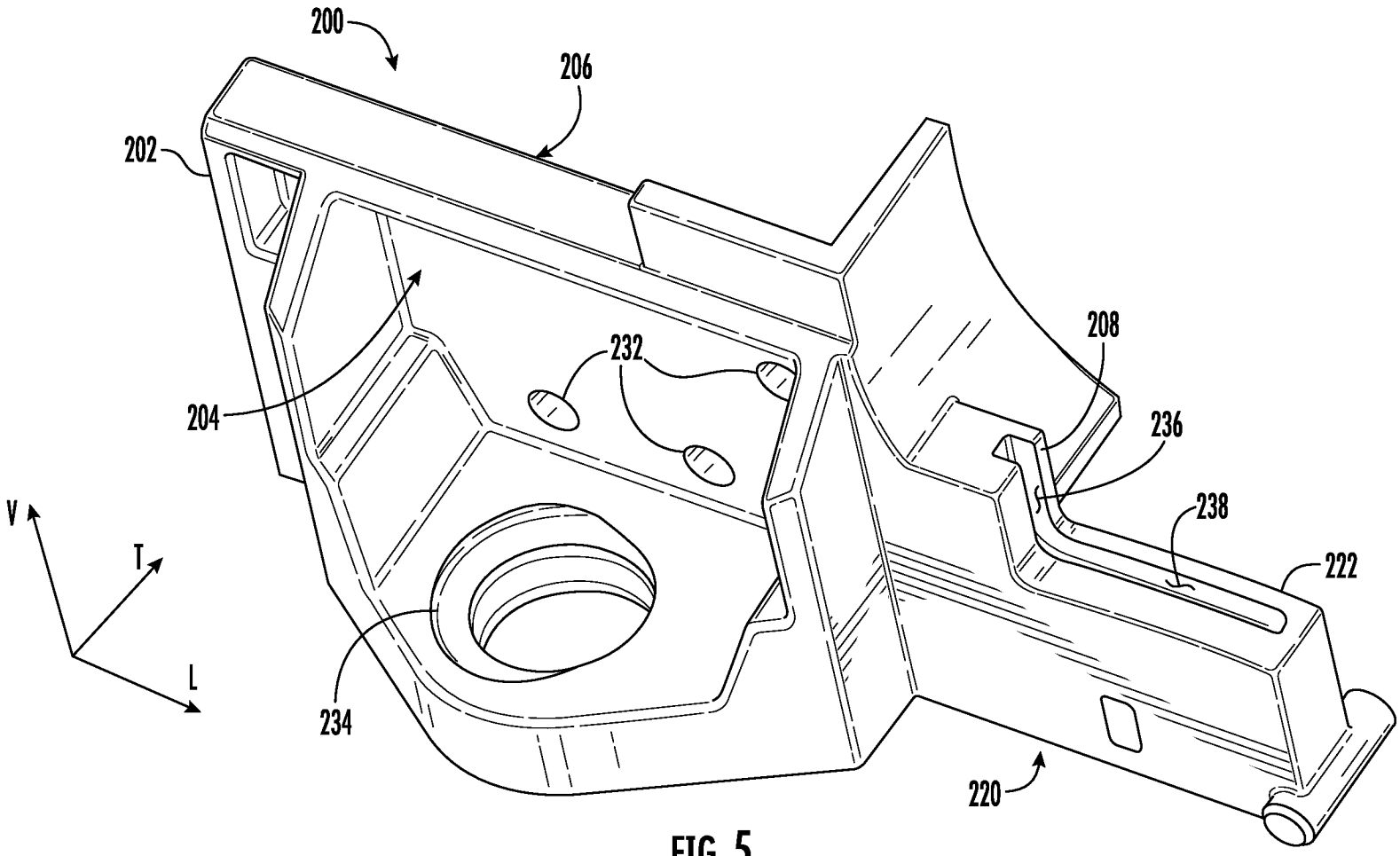
FIG. 5 provides a perspective view of a front drawer guide according to another exemplary embodiment of the present disclosure.

Referring now to FIG. 5, another embodiment of front drawer guide 200 is provided. Due to similarities between embodiments disclosed herein, like reference numerals may be used to refer to the same or similar features. As shown in FIG. 5, lateral sliding support surface 208 may include a lateral groove 236. Lateral groove 236 may be formed into lateral sliding support surface 208 along the lateral direction L. For instance, lateral groove 236 may be recessed laterally inward into lateral sliding support surface 208 (e.g., away from drawer body 109). In some embodiments, although not shown, lateral groove 236 is included along with first protrusion 210. Accordingly, lateral groove 236 may be positioned in front of or behind (e.g., along the transverse direction T) first protrusion 210. The lubricant may be supplied to lateral groove 236 for storage during manufacture or assembly of range appliance 10. Advantageously, the lubricant may be routinely supplied to the contact area between drawer body 109 and front drawer guide 200 when moving drawer body 109 between the inserted and withdrawn positions.

Referring still to FIG. 5, vertical sliding support surface 222 may include a vertical groove 238. Vertical groove 238 may be formed into vertical sliding support surface 222 along the vertical direction V. For instance, vertical groove 238 may be recessed vertically inward into vertical sliding support surface 222 (e.g., away from drawer body 109). In some embodiments, although not shown, vertical groove 238 is included along with second protrusion 224. Accordingly, vertical groove 238 may be positioned in front of or behind (e.g., along the transverse direction T) second protrusion 224. The lubricant may be supplied to vertical groove 238 for storage during manufacture or assembly of range appliance 10. Advantageously, the lubricant may be routinely supplied to the contact area between drawer body 109 and front drawer guide 200 when moving drawer body 109 between the inserted and withdrawn positions. Additionally or alternatively, lateral groove 236 and vertical groove 238 may be connected with one another (e.g., at a junction of lateral sliding support surface 208 and vertical sliding support surface 222).

Figure 6:
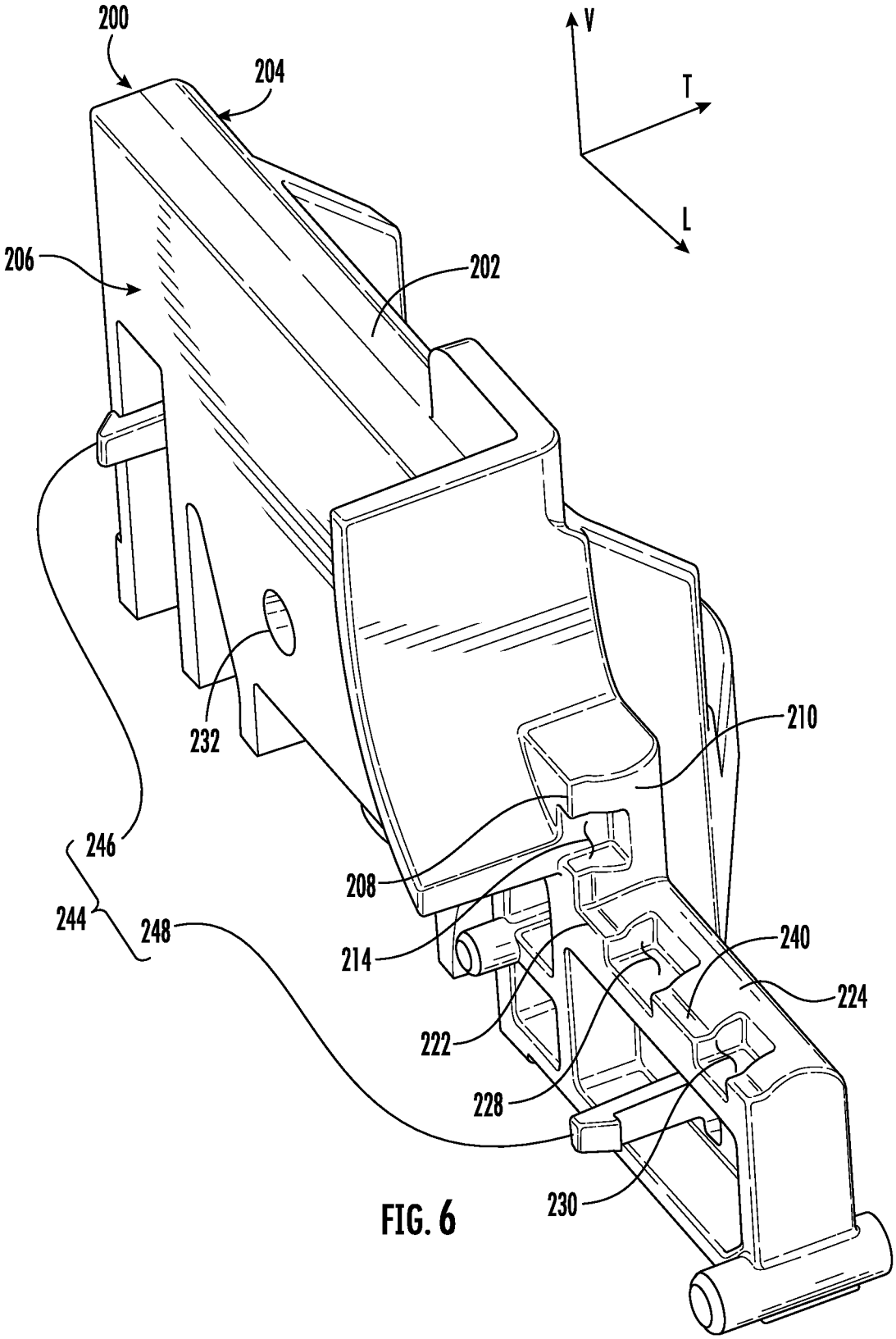
FIG. 6 provides a perspective view of a front drawer guide according to another exemplary embodiment of the present disclosure.
Figure 8:
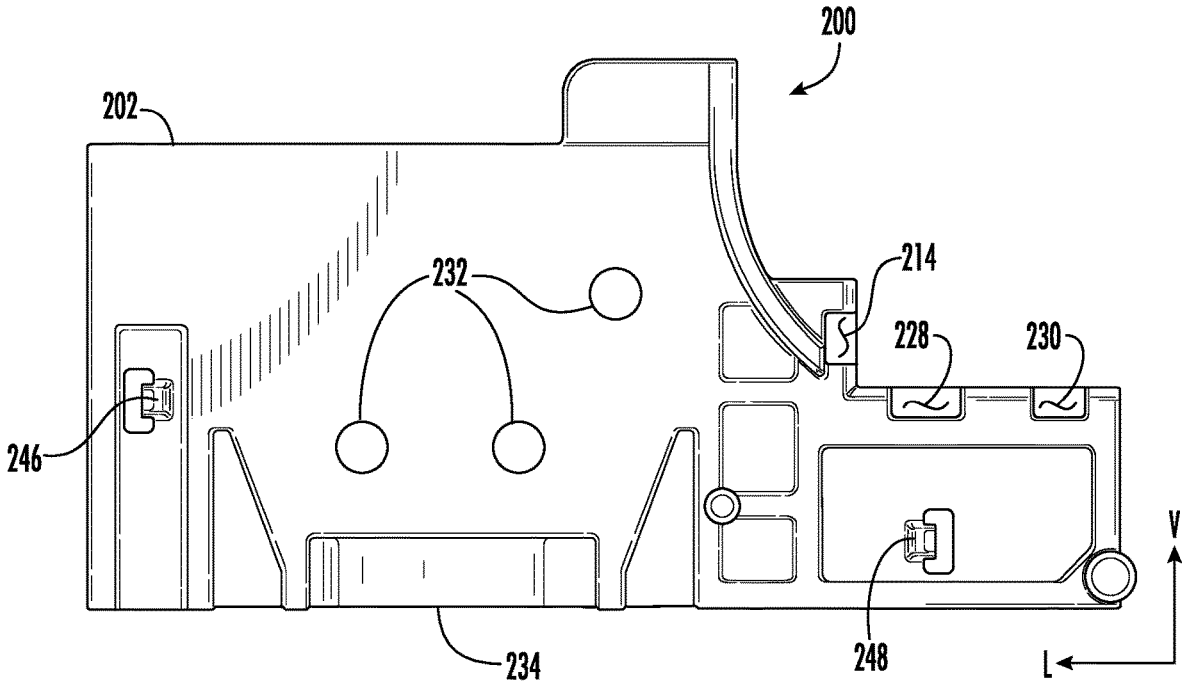
FIG. 8 provides a rear view of the exemplary drawer guide of FIG. 6.

Referring now to FIGS. 6 through 8, another embodiment of front drawer guide 200 is provided. Due to similarities between embodiments disclosed herein, like reference numerals may be used to refer to the same or similar features. As shown in FIG. 6, first vertical lubricant pocket 228 may be provided adjacent to second vertical lubricant pocket 230 along the lateral direction L. In detail, the vertical protrusion distance of second protrusion 224 may be uniform across the lateral length thereof (i.e., first end 2242, center 2241 and second end 2243 may have equal vertical protrusion distances). Second protrusion 224 may thus form a straight leading edge (e.g., facing forward along the transverse direction T). First vertical lubricant pocket 228 and second vertical lubricant pocket 230 may thus be provided behind (e.g., along the transverse direction T) second protrusion 224. Accordingly, first vertical lubricant pocket 228 and second vertical lubricant pocket 230 may be provided laterally adjacent to one another. A tab 240 may be formed between first vertical lubricant pocket 228 and second vertical lubricant pocket 230.

Front drawer guide 200 may include a pair of snap hooks 242. The pair of snap hooks 242 may protrude rearward (e.g., along the transverse direction T) toward an interior of range appliance 10. The pair of snap hooks 242 may be selectively inserted within respective hook holes (not shown) defined within cabinet 101 of range appliance 10. Accordingly, front drawer guide 200 may be snap fitted into place with respect to cabinet 101 (e.g., in addition to or alternatively from the fasteners through fastener apertures 232. A first snap hook 244 may protrude from main body 202 while a second snap hook 246 may protrude from slide extension 220. Accordingly, front drawer guide 200 may be stably coupled to cabinet 100 at two locations spaced apart from one another.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A drawer guide defining a vertical direction, a lateral direction, and a transverse direction, the drawer guide comprising:

a main body defining a lateral slide support surface extending along the vertical direction;

a first protrusion protruding from the lateral slide support surface along the lateral direction to define a lateral lubricant pocket;

a slide extension extending from the main body along the lateral direction, the slide extension defining a vertical slide support surface; and a second protrusion protruding from the vertical slide support surface along the vertical direction to define a vertical lubricant pocket, wherein the slide extension is provided below the first protrusion along the vertical direction such that the lateral slide support surface and the vertical slide support surface form an L shape, wherein:

the lateral lubricant pocket is a first lateral lubricant pocket provided behind the first protrusion along the transverse direction; and the first protrusion further defines a second lateral lubricant pocket provided in front of the first protrusion along the transverse direction.

2. The drawer guide of claim 1, wherein the first protrusion is provided at a center of the lateral slide support surface along the transverse direction.

3. The drawer guide of claim 1, wherein the second protrusion is provided at a center of the vertical slide support surface along the transverse direction.

4. The drawer guide of claim 1, wherein a lateral protrusion distance of the first protrusion varies along the vertical direction such that the lateral protrusion distance of a central portion of the first protrusion is greater than the lateral protrusion distance of a top end and a bottom end of the first protrusion.

5. The drawer guide of claim 1, wherein a vertical protrusion distance of the second protrusion varies along the lateral direction such that the vertical protrusion distance of a central portion of the second protrusion is greater than the vertical protrusion distance of a proximal end and a distal end of the second protrusion.

6. The drawer guide of claim 1, wherein the vertical lubricant pocket is a first vertical lubricant pocket provided behind the second protrusion along the transverse direction.

7. The drawer guide of claim 6, wherein the second protrusion further defines a second vertical lubricant pocket provided in front of the second protrusion along the transverse direction.

8. A drawer assembly for an appliance, the appliance defining a vertical direction, a lateral direction, and a transverse direction, the appliance comprising a frame defining an opening, the drawer assembly comprising:

a drawer body selectively received within the opening between an inserted position and a withdrawn position; and a drawer guide attached to the frame, the drawer guide being in sliding contact with the drawer body, wherein the drawer guide comprises:

a main body defining a lateral slide support surface extending along the vertical direction;

a first protrusion protruding from the lateral slide support surface along the lateral direction to define a lateral lubricant pocket;

a slide extension extending from the main body along the lateral direction, the slide extension defining a vertical slide support surface; and a second protrusion protruding from the vertical slide support surface along the vertical direction to define a vertical lubricant pocket, wherein the slide extension is provided below the first protrusion along the vertical direction such that the lateral slide support surface and the vertical slide support surface form an L shape, wherein:

the lateral lubricant pocket is a first lateral lubricant pocket provided behind the first protrusion along the transverse direction; and the first protrusion further defines a second lateral lubricant pocket provided in front of the first protrusion along the transverse direction.

9. The drawer assembly of claim 8, wherein the first protrusion is provided at a center of the lateral slide support surface along the transverse direction, and wherein the second protrusion is provided at a center of the vertical slide support surface along the transverse direction.

10. The drawer assembly of claim 8, wherein a lateral protrusion distance of the first protrusion varies along the vertical direction such that the lateral protrusion distance of a central portion of the first protrusion is greater than the lateral protrusion distance of a top end and a bottom end of the first protrusion.

11. The drawer assembly of claim 8, wherein a vertical protrusion distance of the second protrusion varies along the lateral direction such that the vertical protrusion distance of a central portion of the second protrusion is greater than the vertical protrusion distance of a proximal end and a distal end of the second protrusion.

12. The drawer assembly of claim 8, wherein the vertical lubricant pocket is a first vertical lubricant pocket provided behind the second protrusion along the transverse direction.

13. The drawer assembly of claim 12, wherein the second protrusion further defines a second vertical lubricant pocket provided in front of the second protrusion along the transverse direction.

* * * * *